US006093914A

United States Patent [19]

Diekmann et al.

[11] Patent Number: 6,093,914

[45] Date of Patent: Jul. 25, 2000

[54] ELECTRIC COOKING APPLIANCE

[76] Inventors: Mark J. Diekmann; Craig F. Diekmann, both of Stage Coach Dr. Lot #11, Sunny Waters Mobile Home Park, Norwich, Conn. 06360

[21] Appl. No.: 09/328,991

[22] Filed: Jun. 10, 1999

[51] Int. Cl.[7] ..... H05B 3/68; H05B 3/02

[52] U.S. Cl. ..... 219/462.1; 219/483

[58] Field of Search ..... 219/451.1, 452.11, 219/452.13, 462.1, 391, 394, 395, 396, 476, 480, 483, 485

[56] References Cited

U.S. PATENT DOCUMENTS

| | | | |
|---|---|---|---|
| 2,442,900 | 6/1948 | McCormick | 219/398 |
| 2,569,775 | 10/1951 | Pearce | 219/392 |
| 3,122,626 | 2/1964 | Welch | 219/395 |
| 4,772,779 | 9/1988 | Scheidler et al. | 99/331 |
| 5,171,973 | 12/1992 | Higgins | 219/457.1 |

OTHER PUBLICATIONS

Copy of Technical data manual for General Electric Electrial Components, dated Jul. 1972, publishing No. 30– 84E–5.

*Primary Examiner*—Sang Paik

[57] ABSTRACT

An electric cooking appliance operable from two 120 VAC household circuits. The electric cooking appliance includes a plurality of surface heating units and a pair of oven heating units operably coupled to two AC power sources. The oven heating units are coupled to one of the power sources through a thermostat and a switching circuit for alternately switching the heating units between a high bake, a high broil, and a dual bake/broil setting. A plurality of surface unit switches interposed between the power source and each surface unit controls the operation and current draw of the each surface unit.

7 Claims, 5 Drawing Sheets

SURFACE UNIT SWITCH
CONTACT DIAGRAM

ELECTRIC COOKING APPLIANCE

BACKGROUND OF THE INVENTION

1. Field of the Invention

The present invention relates to electric appliances and more particularly pertains to a new electric cooking appliance adapted to operate from two 120 VAC household circuits.

2. Description of the Prior Art

The use of electric appliances is known in the prior art. More specifically, electric appliances heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,293,028; 5,159,178; 4,217,481; and 3,921,617.

Electric cooking appliances include heating elements which typically require a significant amount of power during use of the appliance. As a result, these cooking appliances are usually adapted to connect to a relatively higher voltage circuit, such as, for example, a 240 VAC circuit, so that the appliance is supplied with enough power to operate the heating elements at the desired heating level. However, most building structures (such as homes) have only a very limited number of relatively high voltage 240 VAC circuits available as compared to the number of relatively lower voltage (such as, for example, 120 VAC circuits) circuits. The number of high voltage outlets in a structure are similarly limited as compared to the number of lower voltage outlets, and the high voltage outlets are generally available in only a few locations in the structure. Some structures may even lack any 240 VAC circuits and power outlets. These common problems limit the ability to use and locate electric cooking appliances in structures, and in some cases may prevent their use altogether.

While the prior art devices fulfill their respective, particular objectives and requirements, the aforementioned patents do not disclose a new electric cooking appliance adapted to be operated using two AC power sources. The inventive device includes a plurality of surface heating units and a pair of oven heating units operably coupled to two AC power sources. The oven heating units are coupled to one of the power sources through a thermostat and a switching means for alternately switching the heating units between a high bake, a high broil, and a dual bake/broil setting. A plurality of surface unit switches interposed between the power source and each surface unit controls the operation and current draw of the each surface unit.

In these respects, the electric cooking appliance according to the present invention substantially departs from the conventional concepts and designs of the prior art, and in so doing provides an apparatus primarily developed for the purpose of operating from two 120 VAC household circuits.

SUMMARY OF THE INVENTION

In view of the foregoing disadvantages inherent in the known types of electric appliances now present in the prior art, the present invention provides a new electric cooking appliance construction wherein the same can be operated from two 120 VAC household circuits.

The general purpose of the present invention, which will be described subsequently in greater detail, is to provide a new electric cooking appliance apparatus and method which has many of the advantages of the electric appliances mentioned heretofore and many novel features that result in a new electric cooking appliance which is not anticipated, rendered obvious, suggested, or even implied by any of the prior art electric appliances, either alone or in any combination thereof.

To attain this, the present invention generally comprises a plurality of surface heating units and a pair of oven heating units operably coupled to two AC power sources. The oven heating units are coupled to one of the power sources through a thermostat and a switching means for alternately switching the heating units between a high bake, a high broil, and a dual bake/broil setting. A plurality of surface unit switches interposed between the power source and each surface unit controls the operation and current draw of the each surface unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electric cooking appliance apparatus and method which has many of the advantages of the electric appliances mentioned heretofore and many novel features that result in a new electric cooking appliance which is not anticipated, rendered obvious, suggested, or even implied by any of the prior art electric appliances, either alone or in any combination thereof.

It is another object of the present invention to provide a new electric cooking appliance which may be easily and efficiently manufactured and marketed.

It is a further object of the present invention to provide a new electric cooking appliance which is of a durable and reliable construction.

An even further object of the present invention is to provide a new electric cooking appliance which is susceptible of a low cost of manufacture with regard to both materials and labor, and which accordingly is then susceptible of low prices of sale to the consuming public, thereby making such electric cooking appliance economically available to the buying public.

Still yet another object of the present invention is to provide a new electric cooking appliance which provides in the apparatuses and methods of the prior art some of the advantages thereof, while simultaneously overcoming some of the disadvantages normally associated therewith.

Still another object of the present invention is to provide a new electric cooking appliance operable from two 120 VAC household circuits and thereby enable the use of the appliance where a 240 VAC power source is unavailable or inconvenient to the location of the appliance.

Yet another object of the present invention is to provide a new electric cooking appliance which includes a plurality of surface heating units and a pair of oven heating units operably coupled to two AC power sources. The oven heating units are coupled to one of the power sources through a thermostat and a switching means for alternately switching the heating units between a high bake, a high broil, and a dual bake/broil setting. A plurality of surface unit switches interposed between the power source and each surface unit, and these switches control the operation and current draw of the each surface unit.

Still yet another object of the present invention is to provide a new electric cooking appliance that includes a deep-well cooker.

Even still another object of the present invention is to provide a new electric cooking appliance that includes a dual bake/broil setting.

Still yet another object of the present invention is to provide for an appliance which a household having 120 VAC service can use safely and efficiently.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new electric cooking appliance embodying the principles and concepts of the present invention will be described.

As best illustrated in FIGS. 1 through 6, the electric cooking appliance generally comprises a plurality of surface heating units and a pair of oven heating units operably coupled to two AC power sources. The oven heating units are coupled to one of the power sources through a thermostat and a switching means for alternately switching the heating units between a high bake, a high broil, and a dual bake/broil setting. A plurality of surface unit switches interposed between the power source and each surface unit controls the operation and current draw of the each surface unit.

Figure 1A:
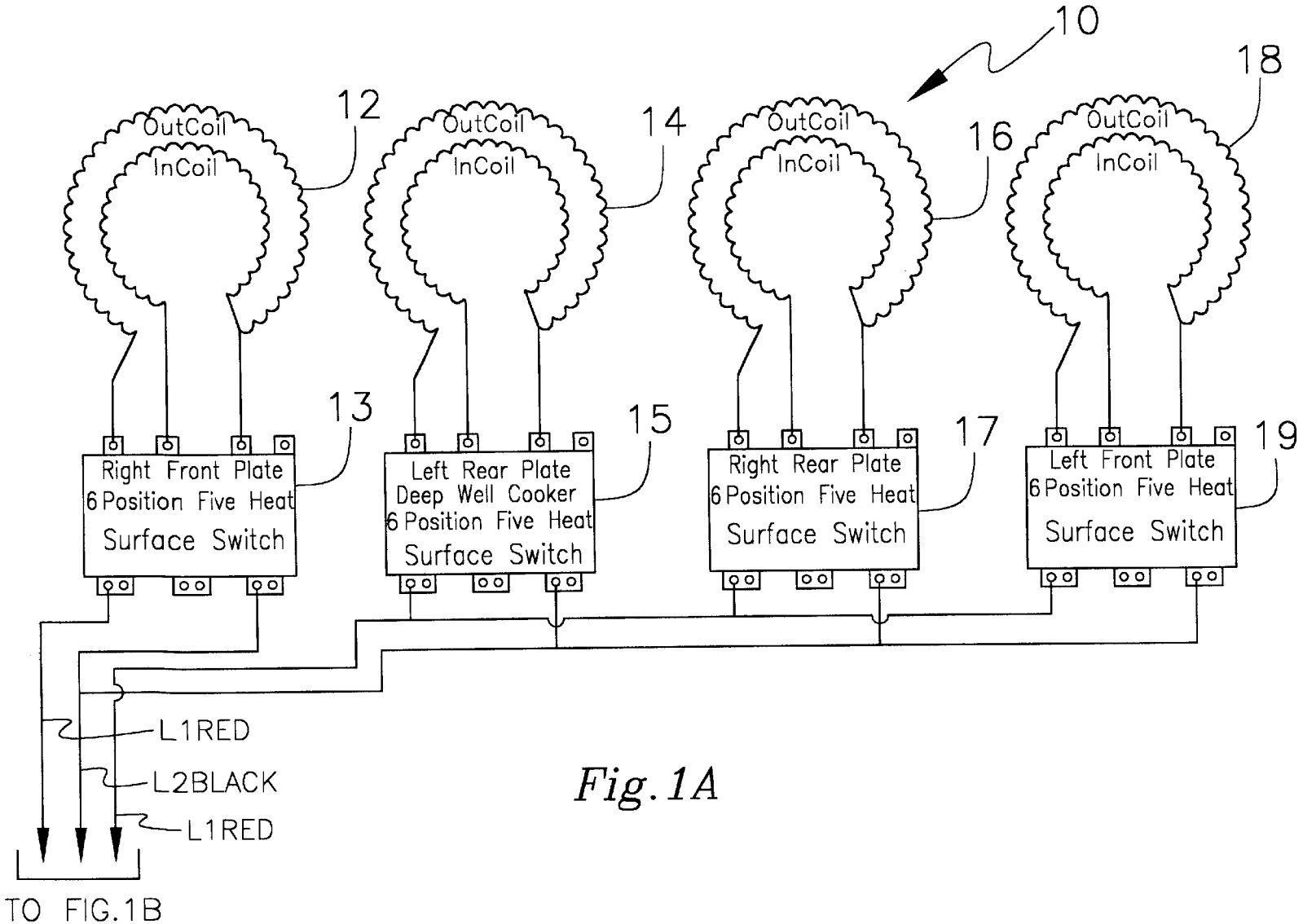
FIG. 1A is a schematic diagram of a first circuitry portion of a new electric cooking appliance according to the present invention.
Figure 1B:
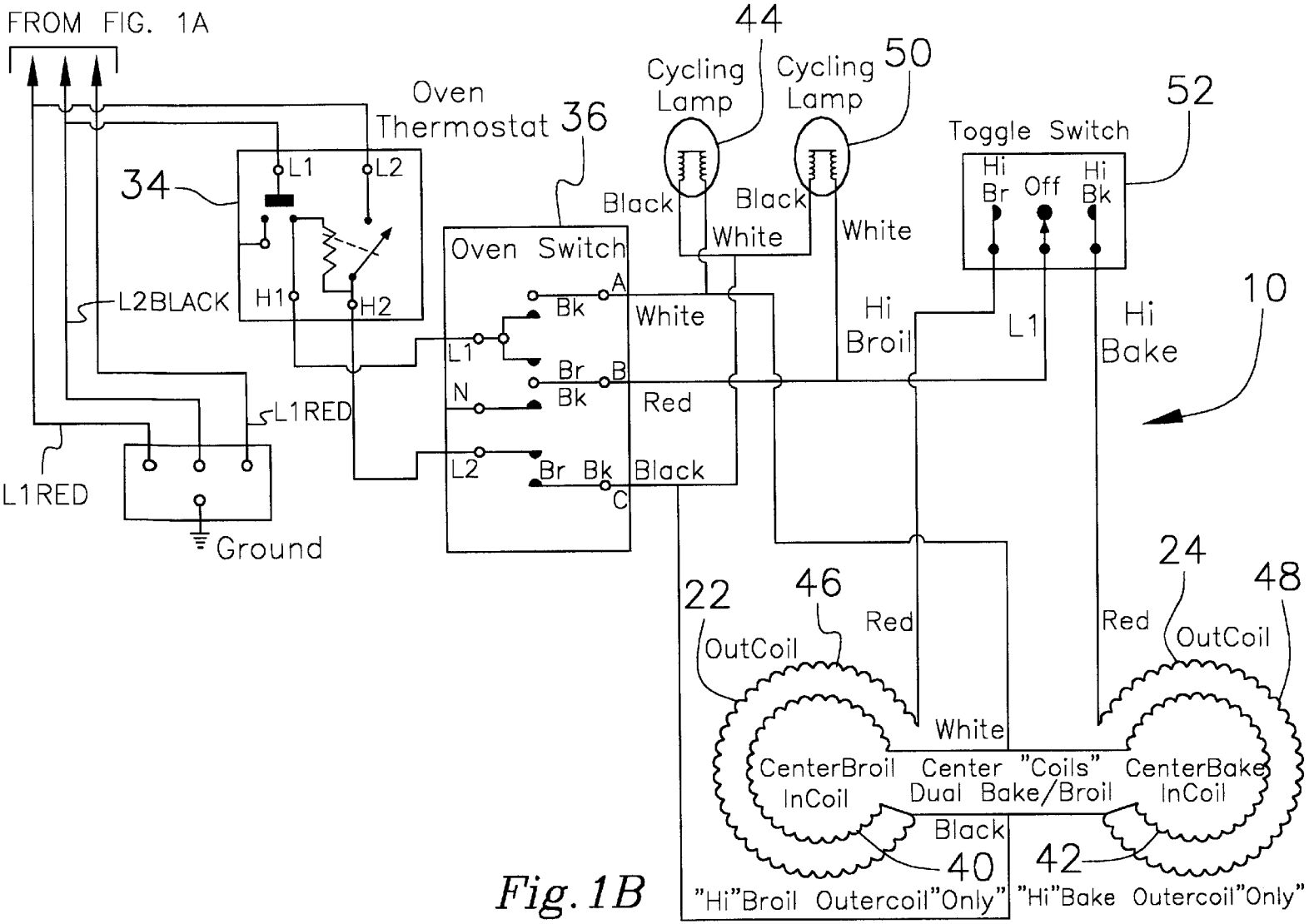
FIG. 1B is a schematic diagram of a second circuitry portion of the new electric cooking appliance according to the present invention.

With reference to FIGS. 1A and 1B, the cooking appliance of the present invention is shown including a plurality of resistive heating units designated generally at 10. A plurality of surface heating units 12, 14, 16, and 18 are shown operably coupled to 120 VAC power supplies through a plurality of corresponding surface unit switches 13, 15, 17, and 19 as further described below. Each surface heating unit is of a type well known in the art and includes an inner coil and an outer coil. Surface heating unit 14 is further disposed within the stovetop in a deep-well manner well known in the art.

The first surface heating unit 12 is operably connected to a first power source, while the remaining surface heating units 14. 16, and 18 are operably connected to a second power source.

Figure 4:
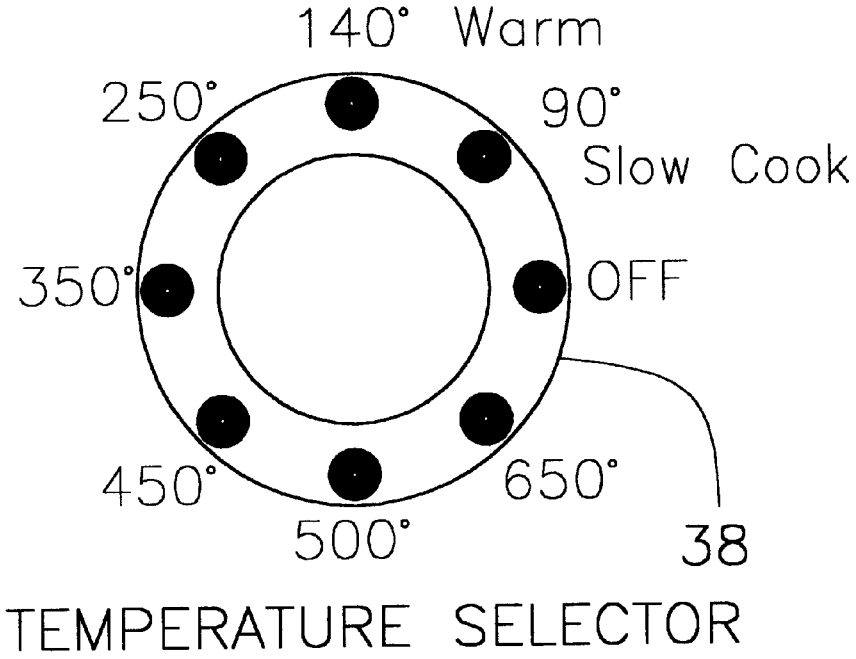
FIG. 4 is a schematic diagram of a surface unit switch of the present invention.
Figure 5:
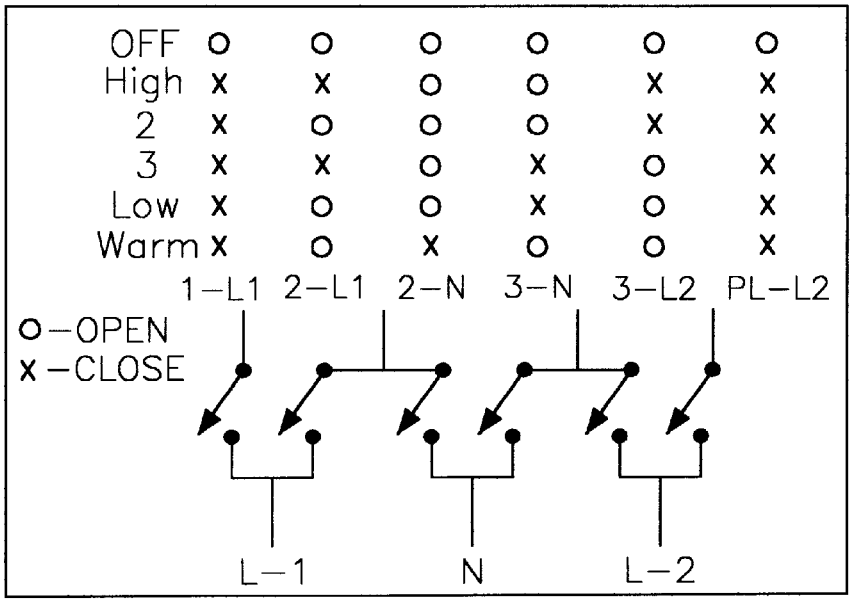
FIG. 5 is a schematic diagram of a surface unit switch contact of the present invention.

Each surface unit switch 13, 15, 17, and 19 is a six-position contact switch 20 of a type well known in the art. A circuit diagram of each switch is shown in FIG. 4. In conjunction with the diagram shown in FIG. 5, each contact switch 20 is operable to heat each surface heating unit 10 to one of five temperatures.

Figure 6:
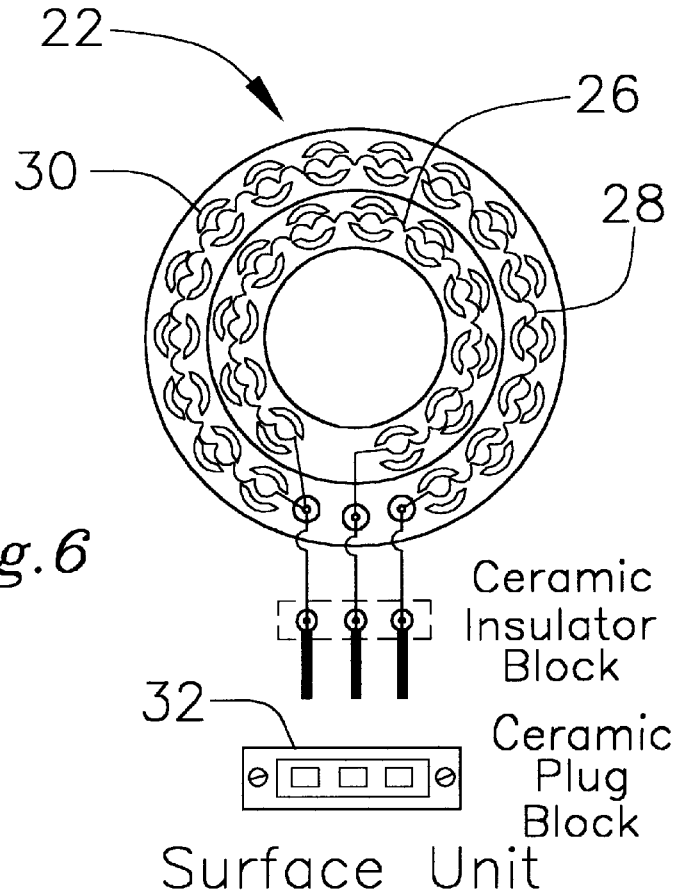
FIG. 6 is a schematic diagram of the surface unit of the present invention.

A pair of oven heating units 22 and 24 are shown in FIG. 1B operably coupled to the first power source. The oven heating units 22 and 24 are preferably disposed in spaced relationship within the oven and may be of a type such as is illustrated in FIG. 6. Each oven heating unit 22 and 24 includes an inner resistive heating element 26 and an outer resistive heating element 28. Oven heating elements 22 and 24 are operably connected at ends thereof at terminal "A", the other end of oven heating element 22 being operably coupled to terminal "B" and the other end of oven heating element 24 being operably coupled to terminal "C". Each oven heating element 22 and 24 is surrounded by insulator bead 30 of the type well known in the art. A ceramic plug block 32 is fixedly attached to the rear wall of the oven (not shown) and is adapted to operably receive the terminals "A", "B", and "C".

An infinite control thermostat 34 is shown operably coupled to the oven heating elements 22 and 24 through a pushbutton oven switch 36. The infinite control thermostat 34 includes a bi-metal control which regulates the switch on-off time and thereby the power dissipated in each oven heating element 22 and 24 to control the heat produced by each. A temperature control means includes a temperature knob 38 operably attached to a cam (not shown) of the infinite control thermostat 34.

Figure 2:
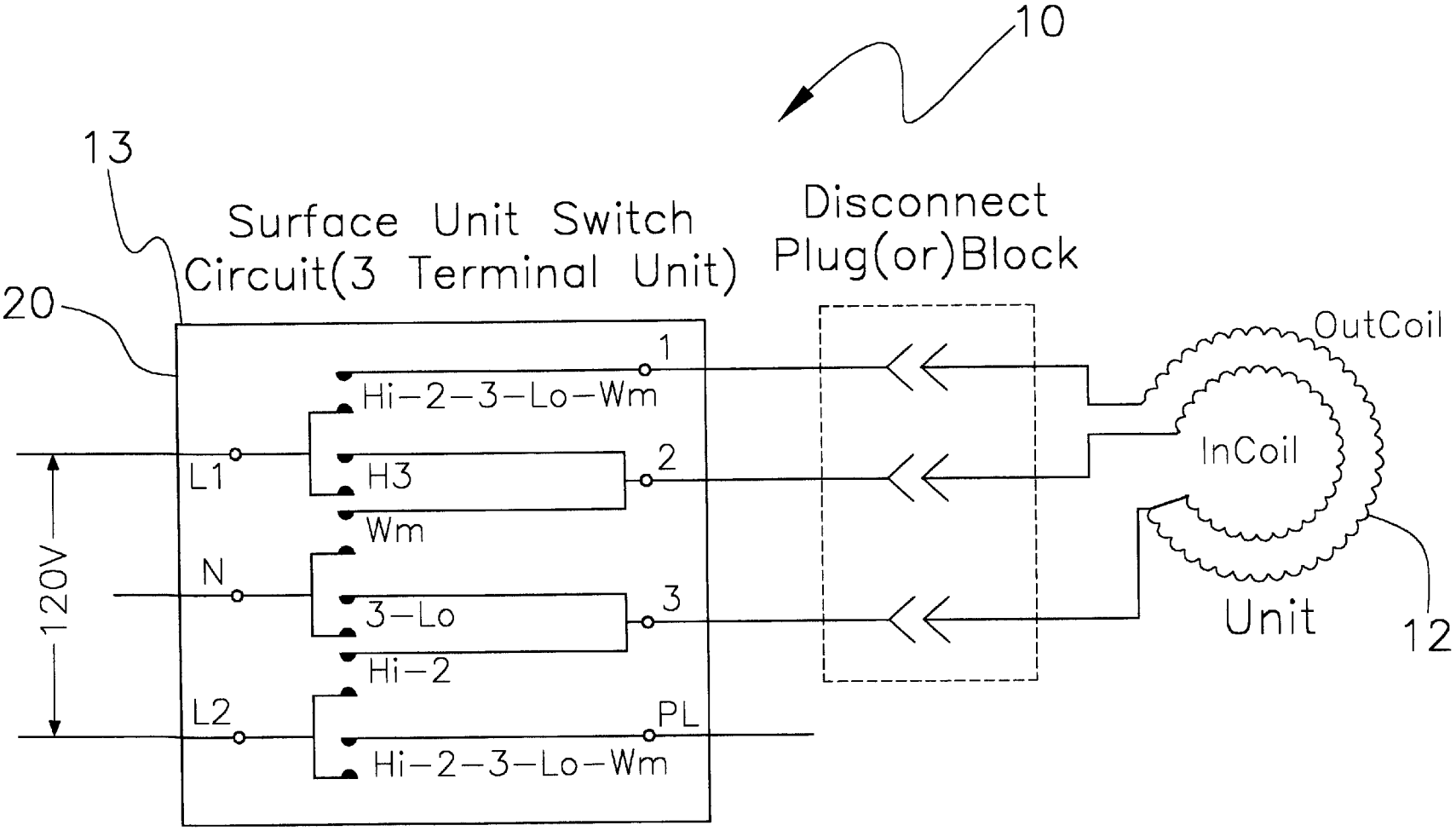
FIG. 2 is a schematic diagram of a temperature selector of the present invention.
Figure 3:
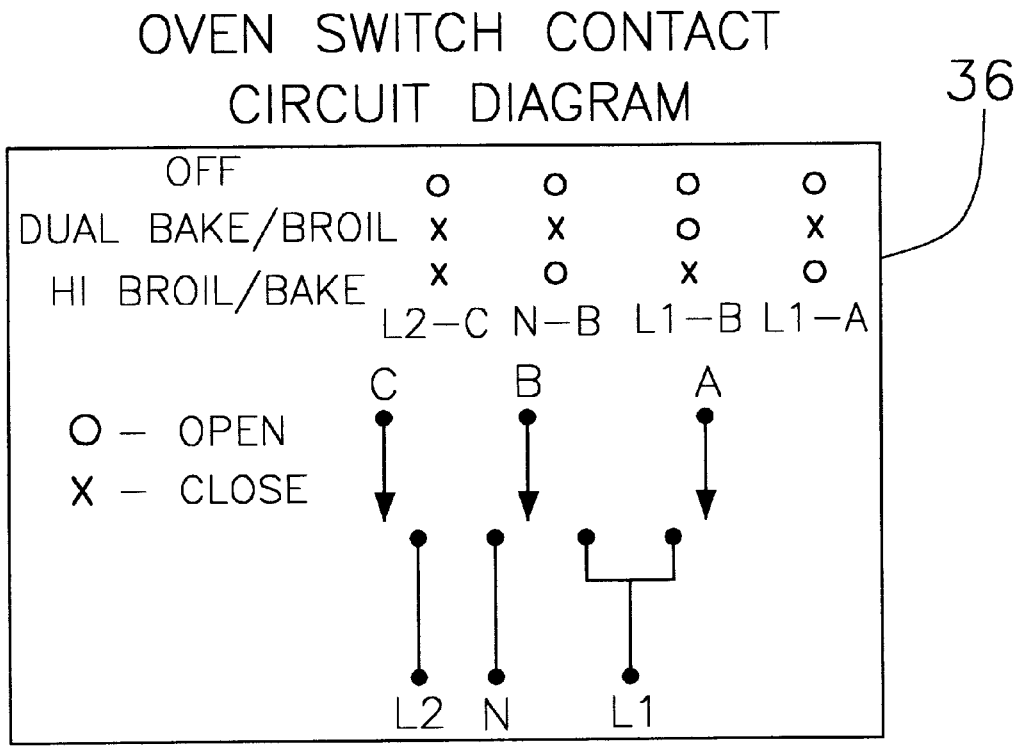
FIG. 3 is a schematic diagram of an oven switch contact circuit of the present invention.

With reference to FIG. 2, the oven switch diagram includes three settings, namely, off, dual bake/broil, and high broil/bake. As shown, the dual bake/broil setting energizes the inner coils 40 and 42 of the oven heating elements 22 and 24 respectively. In this mode of operation, cycling lamp 44 is operable to blink if the temperature is not set to maximum to pre-heat the oven.

In the high broil/bake mode of operation, outer heating coils 46 and 48 are alternatively energized in addition to the respective inner coils 40 and 42 to provide for maximum heating in the oven. In this mode of operation, cycling lamp 50 is operable to blink if the temperature setting is not set to maximum to pre-heat the oven.

A toggle switch 52 may be operably coupled to the oven heating elements 22 and 24 and is operable to switch between oven heating coil 22, designated high broil, and oven heating coil 24, designated high bake. Preferably, oven heating coil 22 is disposed in a lower portion of the oven while the oven heating coil 24 is disposed in a upper portion of the oven to effect baking and broiling respectively.

In use, a person using the electric cooking appliance optionally may energize any of the plurality of surface heating units 12, 14, 16, and 18. If desired, surface heating unit 12 may be de-energized while using the oven heating units 22 and 24 to limit the current draw from the second power source. In this manner, the electric cooking appliance of the present invention provides for an appliance which a household having 120 VAC service can use safely and efficiently.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An electrical cooking appliance for use with a first power source of approximately 120 volts and a second power source of approximately 120 volts without requiring a 240 volt power source, the electrical cooking appliance comprising:

a power supply circuit adapted to be connected to the first power source and the second power source, the power supply circuit having a first hot line for connecting to the first power source, a second hot line for connecting to the second power source, and a neutral line;

a plurality of surface heating units;

a pair of oven heating units;

wherein a first of the plurality of surface heating units and the pair of oven heating units are connected to the neutral line and the first hot line of the power supply circuit for supplying power from the first power source to the first surface heating unit and the pair of oven heating units; and wherein the remaining surface heating units are connected to the neutral line and the second hot line of the power supply circuit for supplying power from the second power source to the remaining surface heating units.

2. The electrical cooking appliance of claim 1 further comprising a thermostat means operably coupled between the first power source and the oven heating units.

3. The electrical cooking appliance of claim 2 wherein the thermostat means further comprise an infinite heat control.

4. The electrical cooking appliance of claim 1 further comprising a plurality of switching means each operably coupled between the power supply circuit and a respective surface heating unit.

5. The electrical cooking appliance of claim 1 wherein each of the pair of oven heating units comprises dual coils, a first one of the pair of oven heating units comprising a broil heating unit and a second one of the pair of oven heating units comprising a bake heating unit, wherein one of the coils of each of the bake heating unit and the broil heating unit are supplied with power in a first cooking mode, one of the coils of the broil heating unit and both of the coils of the bake heating unit are supplied with power in a second cooking mode, and one of the coils of the bake heating unit and both of the coils of the broil heating unit are supplied with power in a third cooking mode.

6. The electrical cooking appliance of claim 5 wherein a toggle switch controls the selection of the first, second, and third cooking modes.

7. An electrical cooking appliance for use with a first power source of approximately 120 volts and a second power source of approximately 120 volts without requiring a 240 volt power source, the first power source being provided by an electrical power circuit of a building separate from an electrical power surface providing the second power source, the electrical cooking appliance comprising:

a power supply circuit adapted to be connected to the first power source and the second power source, the power supply circuit having a first hot line for connecting to the first power source, a second hot line for connecting to the second power source, and a neutral line;

a plurality of surface heating units;

a pair of oven heating units;

wherein a first of the plurality of surface heating units and the pair of oven heating units are connected to the neutral line and the first hot line of the power supply circuit for supplying power from the first power source to the first surface heating unit and the pair of oven heating units; and wherein the remaining surface heating units are connected to the neutral line and the second hot line of the power supply circuit for supplying power from the second power source to the remaining surface heating units;

a thermostat means operably coupled between the first power source and the oven heating units, the thermostat means further comprising an infinite heat control;

a plurality of switching means each operably coupled between the power supply circuit and a respective surface heating unit;

wherein each of the pair of oven heating units comprises dual coils, a first one of the pair of oven heating units comprising a broil heating unit and a second one of the pair of oven heating units comprising a bake heating unit, wherein one of the coils of each of the bake heating unit and the broil heating unit are supplied with power in a first cooking mode, one of the coils of the broil heating unit and both of the coils of the bake heating unit are supplied with power in a second cooking mode, and one of the coils of the bake heating unit and both of the coils of the broil heating unit are supplied with power in a third cooking mode; and wherein a toggle switch controls the selection of the first, second, and third cooking modes.

* * * * *